US010611018B2

(12) United States Patent
Ko

(10) Patent No.: US 10,611,018 B2
(45) Date of Patent: Apr. 7, 2020

(54) TOOLBOX

(71) Applicant: Ming-Hong Ko, Taichung (TW)

(72) Inventor: Ming-Hong Ko, Taichung (TW)

( * ) Notice: Subject to any disclaimer, the term of this patent is extended or adjusted under 35 U.S.C. 154(b) by 0 days.

(21) Appl. No.: 15/921,755

(22) Filed: Mar. 15, 2018

(65) Prior Publication Data

US 2019/0283234 A1 Sep. 19, 2019

(51) Int. Cl.
*B25H 3/02* (2006.01)
*B25H 3/00* (2006.01)
*B25H 3/04* (2006.01)

(52) U.S. Cl.
CPC ..... *B25H 3/025* (2013.01); *B25H 3/003* (2013.01); *B25H 3/04* (2013.01)

(58) Field of Classification Search
CPC ..... B25H 3/003; B25H 3/025
USPC ..... 206/373, 372
See application file for complete search history.

(56) References Cited

U.S. PATENT DOCUMENTS 6,105,767 A * 8/2000 Vasudeva ..... B25H 3/023 206/349
8,267,247 B1 * 9/2012 Horiyama ..... B25H 3/025 206/373

* cited by examiner

*Primary Examiner* — Anthony D Stashick
*Assistant Examiner* — L E Kmet
(74) *Attorney, Agent, or Firm* — Alan D. Kamrath; Karin L. Williams; Mayer & Williams PC

(57) ABSTRACT

A toolbox contains two covers which are rotatably connected with each other and are rotated away from or close to each other so as to open or close the toolbox. At least one of the two covers includes a shell, a frame, and a tool rack. The shell includes a bottom wall and an annular wall, and the annular wall extends upward from and surrounds the bottom wall so as to define a hollow receiving space with the bottom wall. The frame surrounds the annular wall and connect with the tool rack so that the shell is engaged between frame and tool rack.

10 Claims, 6 Drawing Sheets

TOOLBOX

FIELD OF THE INVENTION

The present invention relates to a toolbox.

BACKGROUND OF THE INVENTION

A conventional toolbox is applied to accommodate multiple tools. Preferably, the toolbox and the multiple tools are packed together for sale.

The toolbox is made of plastic or rubber in an injection molding manner so as to obtain an exact structure and appearance and silky touch. Preferably, the toolbox is made in multi-shot sequential injection molding or bi-injection molding so as to achieve multiple hardness and colors.

However, in producing toolboxes with injection molding, precise molds are necessary, causing increased production costs. To spread the cost of the molds, the toolboxes must be produced in mass production. Therefore, manufacturers are forced to deal with increasing inventory pressure. Affordable variations of models of the toolboxes are limited. When a new model is published on the market, manufacturers and retailers are unable to make changes to their productions lines to follow the market.

The present invention has arisen to mitigate and/or obviate the afore-described disadvantages.

SUMMARY OF THE INVENTION

The primary objective of the present invention is to provide a toolbox which may be manufactured in various manners other than injection molding so as to reduce the production cost.

Another objective of the present invention is to provide a toolbox which can be produced with a minimized quantity of each batch with an affordable cost. With a minimized quantity of each production batch, manufacturers may flexibly change appearance of the toolbox.

To obtain above-mentioned objectives, a toolbox provided by the present invention includes two covers which are rotatably connected with each other and are rotated away from or close to each other so as to open or close the toolbox.

At least one of the two covers includes a shell, a frame, and a tool rack. The shell includes a bottom wall and an annular wall, and the annular wall extends upward from and surrounds the bottom wall so as to define a hollow receiving space with the bottom wall. The frame surrounds the annular wall and connects with the tool rack. The shell is clipped between the frame and the tool rack.

Thereby, the toolbox contains the two covers, and each cover includes the shell, the frame, and the tool rack, wherein the shell has the bottom wall and the annular wall which are made in various manners except for injection molding so as to reduce fabrication cost and the quantity of the stock material and to change the appearance of the toolbox by replacing the shell, thus enhancing production flexibility.

DETAILED DESCRIPTION OF THE PREFERRED EMBODIMENTS

Figure 1:
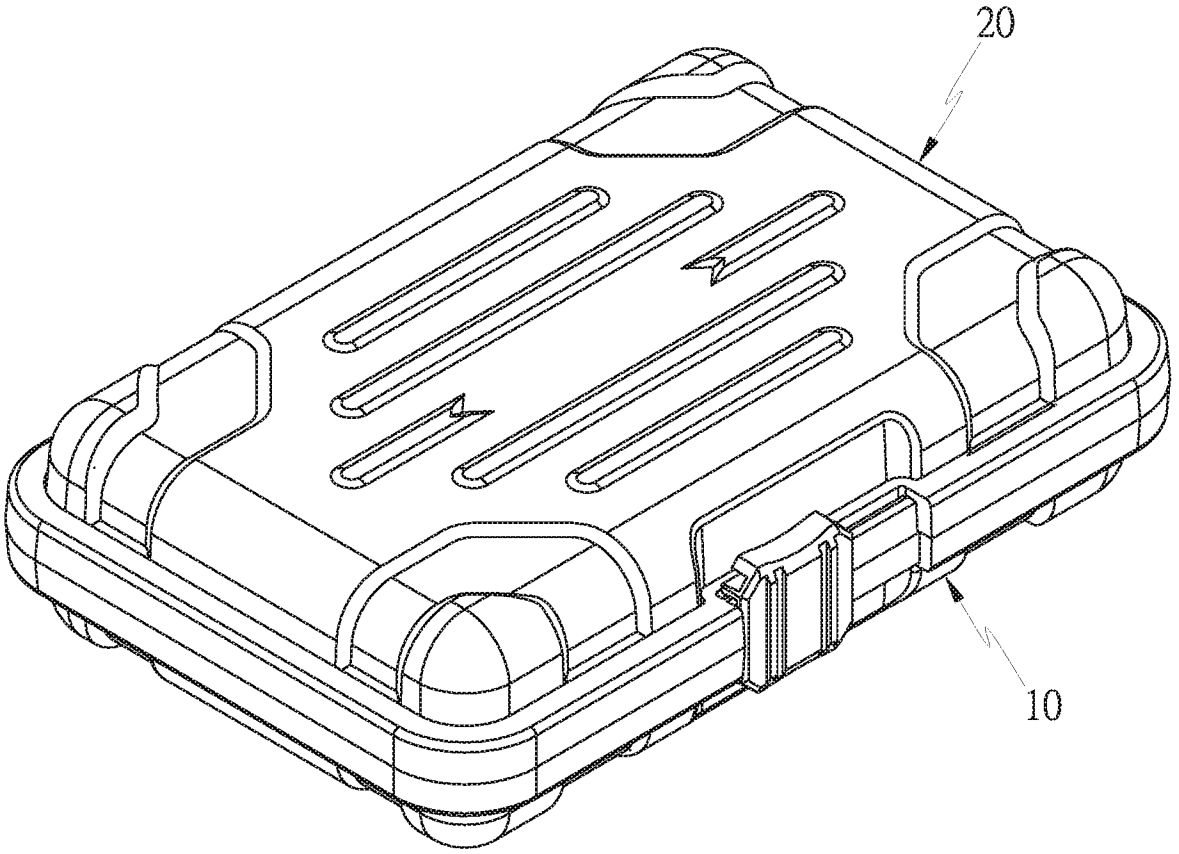
FIG. 1 is a perspective view showing the assembly of a toolbox according to a preferred embodiment of the present invention.
Figure 2:
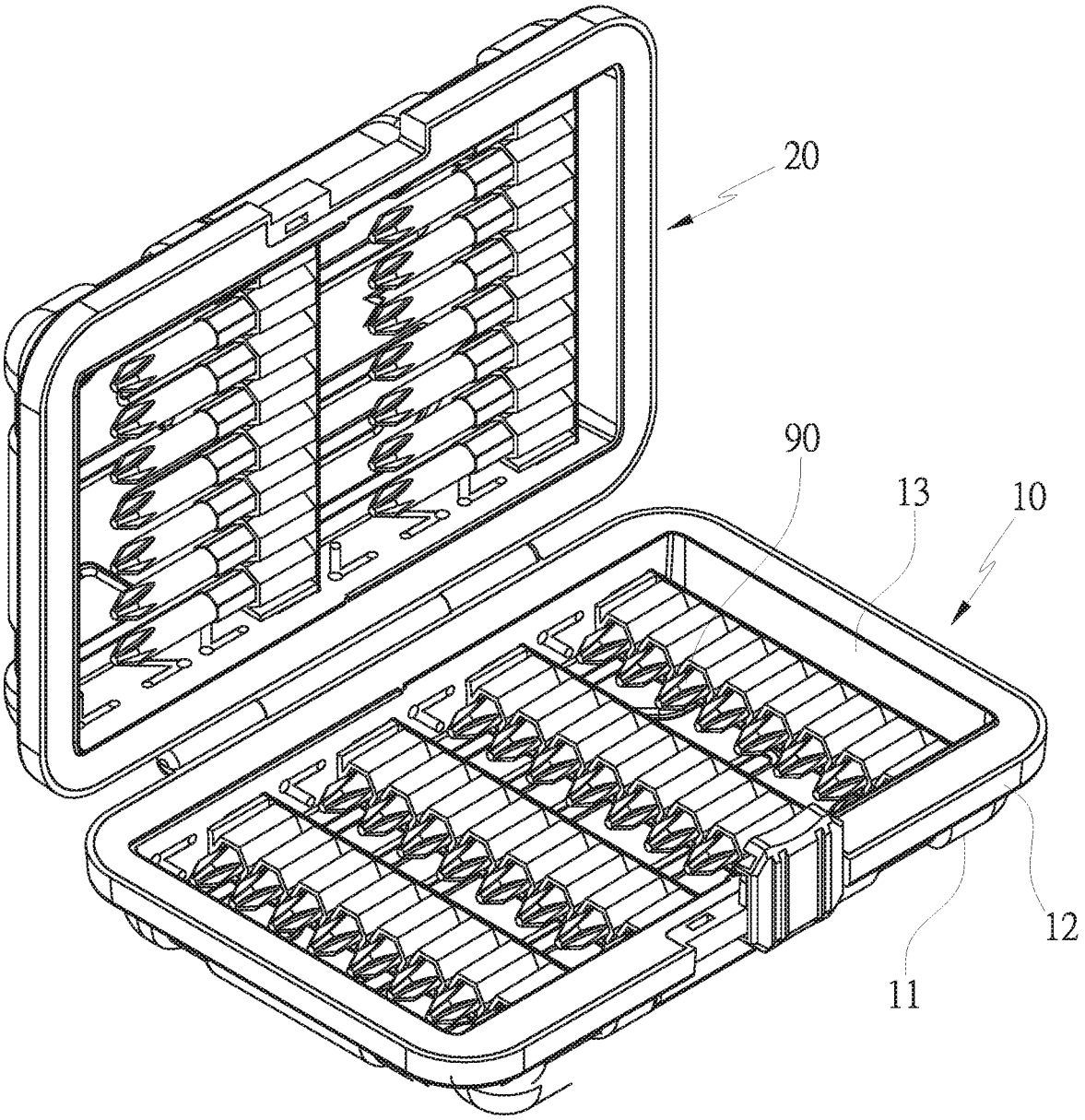
FIG. 2 is a perspective view showing the operation of the toolbox according to the preferred embodiment of the present invention.
Figure 4:
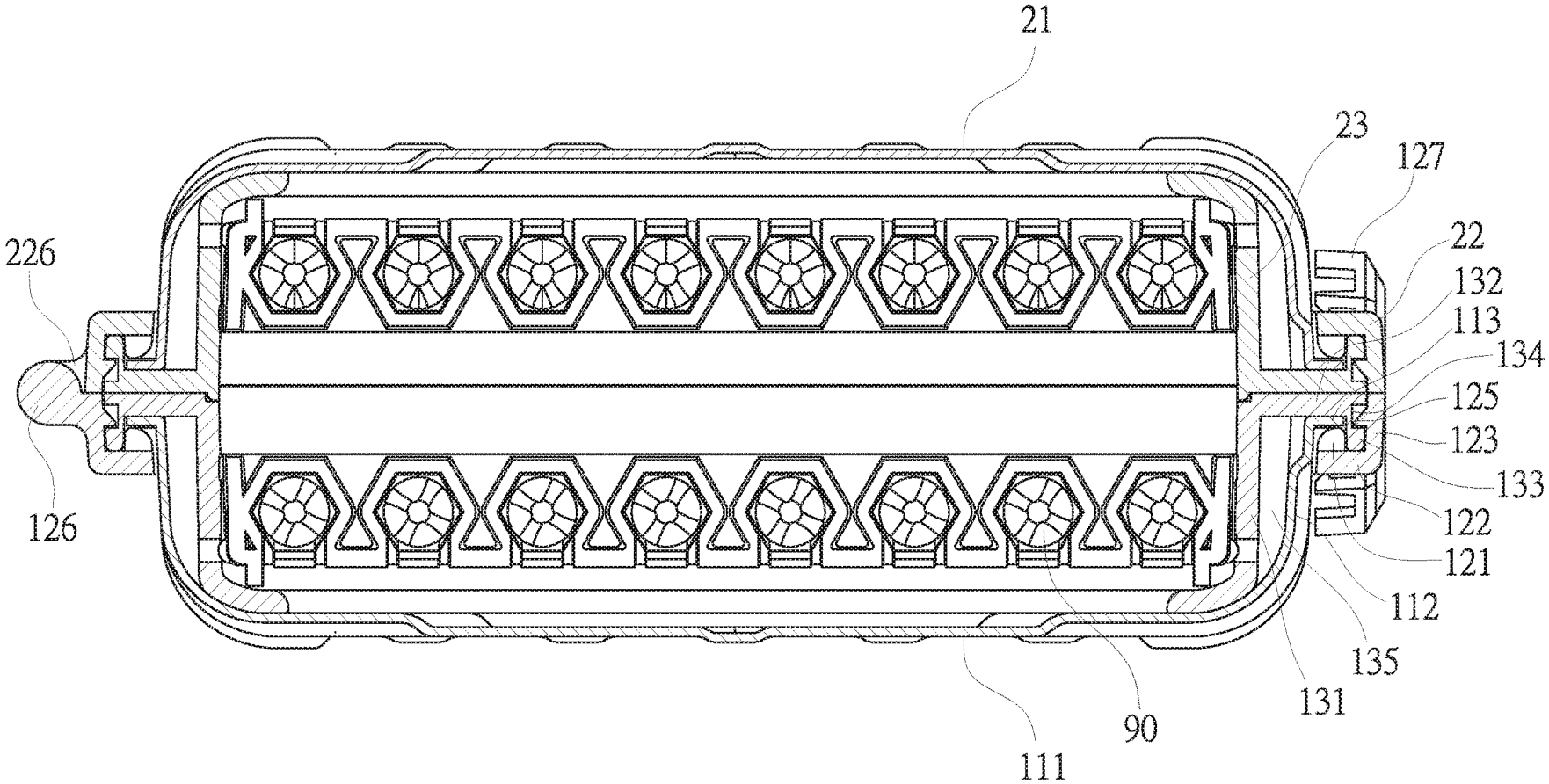
FIG. 4 is a cross sectional view showing the assembly of the toolbox according to the preferred embodiment of the present invention.

With reference to FIGS. 4-5, a toolbox according to a preferred embodiment of the present invention is employed to accommodate multiple tools 90 (such as a wrench, sockets, or bits) and includes two covers 10, 20 which are rotatably connected with each other, as shown in FIGS. 1 and 2. The two covers 10, 20 are rotated away from or close to each other so as to open or close the toolbox. Since one of the two covers 10 is identical to the other cover 20, further remarks regarding the other cover 20 are omitted.

Referring to FIGS. 1-4, the one cover 10 includes a shell 11, a frame 12, and a tool rack 13.

The shell 11 is a thin-walled structure and includes a bottom wall 111, an annular wall 112, and a locking lip 113. The annular wall 112 extends upward from and surrounds the bottom wall 111 so as to define a hollow receiving space 114 with the bottom wall 112. The hollow receiving space 114 faces the other cover 20. The locking lip 113 extends outward from one end of the annular wall 112 away from the bottom wall 111, wherein the locking lip 113 is perpendicular to the annular wall 112 and is parallel to the bottom wall 111 so that the annular wall 112 connects between the locking lip 113 and the bottom wall 111. The shell 11 further includes multiple bend sections formed on the bottom wall 111 and the annular wall 112 so as to reinforce the bottom wall 111 and the annular wall 112. The shells 11, 21 are made of any one of polycarbonate (PC), acrylonitrile butadiene styrene (ABS), PC composites, and ABS resin composite, wherein the PC composite and ABS resin composite combine with cloth material or fabric material. In some cases, the shells 11, 21 may be made of aluminum or aluminum alloy. The shells 11, 21 may be made by any one of stamping, extension, hot forming, and blow molding.

Figure 3:
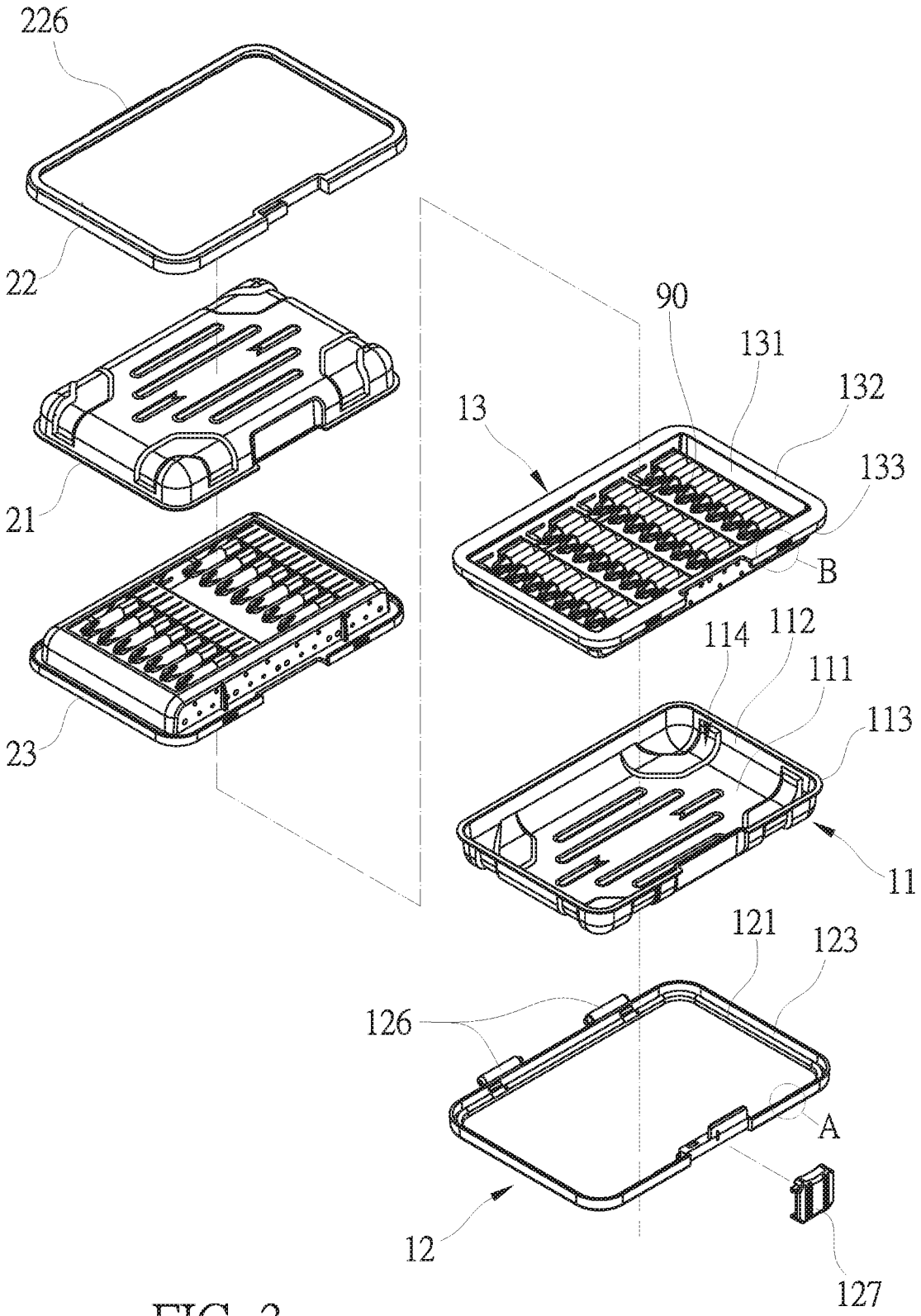
FIG. 3 is a perspective view showing the exploded components of the toolbox according to the preferred embodiment of the present invention.
Figure 3A:
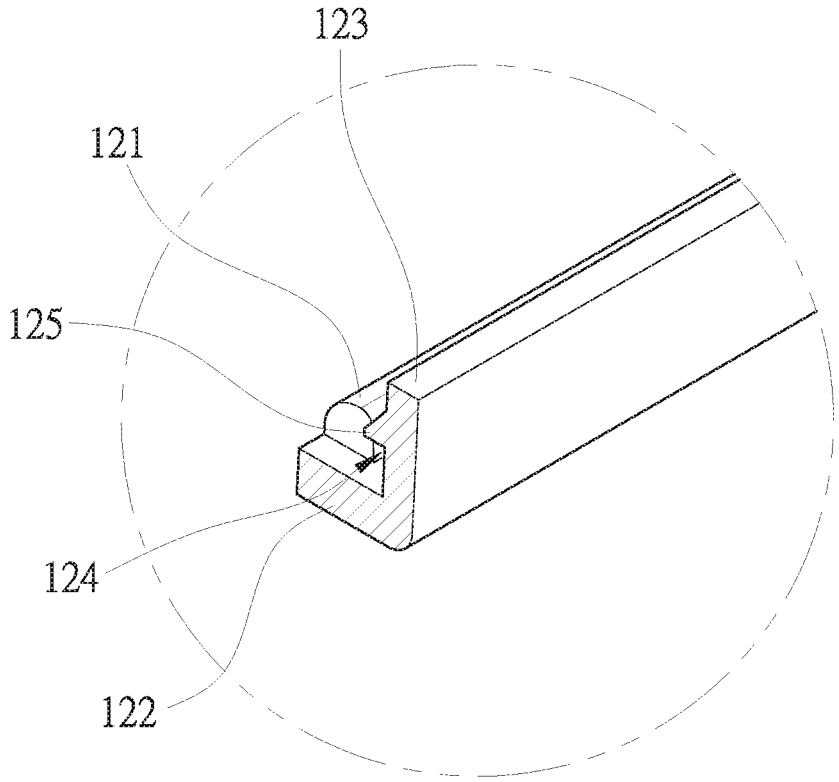
FIG. 3A is a cross sectional view of a portion A of FIG. 3.

Referring to FIGS. 3, 3A, and 4, the frame 12 is annular and surrounds the annular wall 112, wherein the frame 12 includes an internal fence 121, an extending fence 122, and an external fence 123. The internal fence 121 is annular and abuts against the annular wall 112 and the locking lip 113, the extending fence 122 connects between the internal fence 121 and the external fence 123 so that a slit 124 is defined between the internal fence 121 and the external fence 123. The frame 12 includes multiple retaining portions 125 extending toward the internal fence 121 from the external fence 123. Each of the multiple retaining portions 125 is in a hook shape, wherein the internal fence 121 has a notch formed adjacent to the multiple retaining portions 125. As shown in FIGS. 1-4, the internal fence 121 has a connection portion 126 and a switch 127 which are formed on two opposite sides of the frame 12 respectively, wherein the connection portion 126 has two bolts inserted into two ends of a connection portion 226 of the frame 22 of the other cover 20 so that the connection portion 126 of the one cover 10 rotatably connects with the connection portion 226 of the other cover 20. As illustrated in FIGS. 1 and 2, the switch 127 is slidably mounted on the frame 22 so as to avoid unexpected opening of the two covers 10, 20.

Figure 3B:
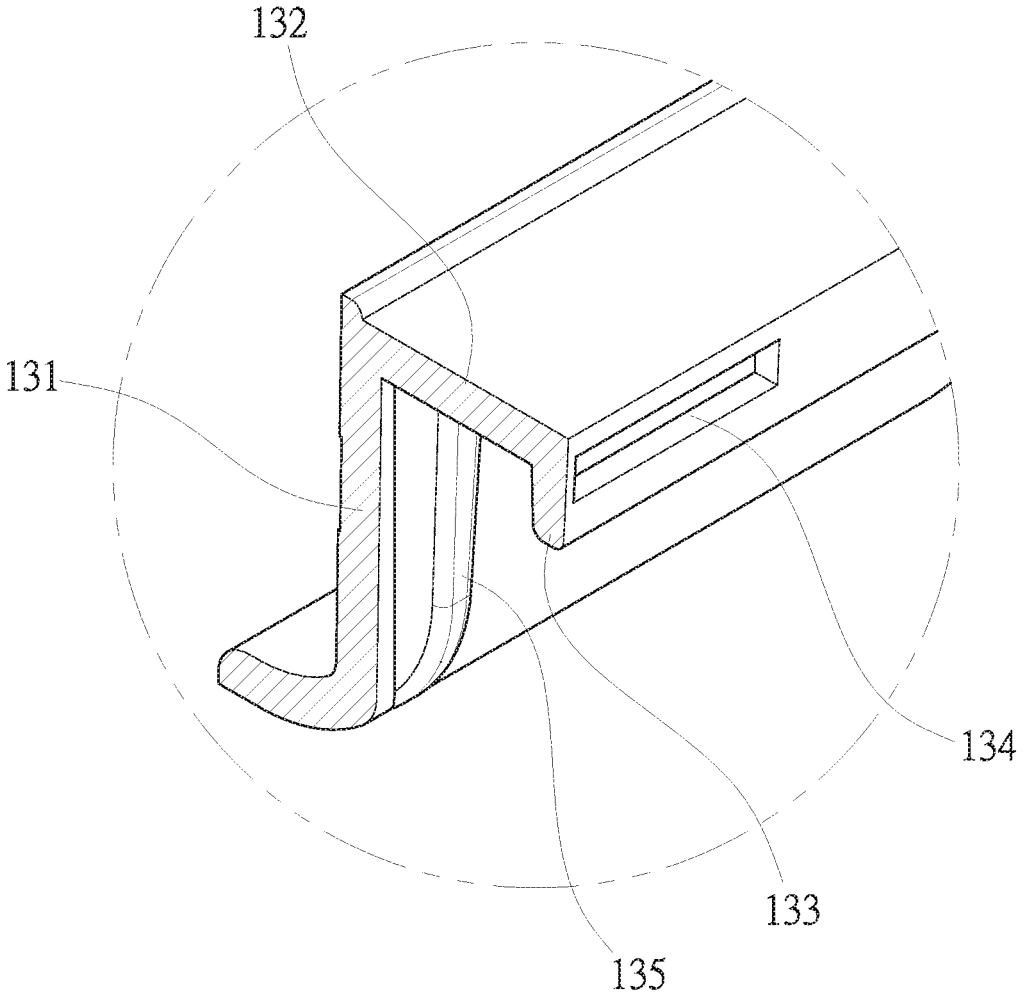
FIG. 3B is a cross sectional view of a portion B of FIG. 3.

The tool rack 13 includes a body 131, a joining fringe 132, and an engagement fringe 133, wherein the body 131 is accommodated in the receiving space 114 and configured to detachably receive and storage the tools 91 on the body 131, wherein the body 131 has a rotatable fixer on which a plurality of orifices are formed so as to accommodate the multiple tools 90 individually. With reference to FIGS. 3, 3B, and 4, the joining fringe 132 extends outwardly to connect to the engagement fringe 133 from the body 131, extending passing by the annular wall 112 and the locking lip 113 so that the engagement fringe 133 surrounds the annular wall 112. The engagement fringe 133 is located in the slit 124, hence the frame 12 is engaged with the engagement fringe 133. The engagement fringe 133 is retained between the internal fence 121 and the external fence 123, and the locking lip 113 of the shell 11 is clipped between the internal fence 121 and the joining fringe 132 of the tool rack 13. Noted that the locking lip 113 is supposed to touch the internal fence 121 and the joining fringe 132 to be clipped therebetween and to be firmly positioned. However, tolerance may still exist on the locking lip 113, the internal fence 121, and the joining fringe 132, causing internal gaps therebetween. In such circumstances, the locking lip 113 is still considered being clipped. Referring to FIGS. 1-4, the tool rack 13 further includes multiple slots 134 corresponding to and retaining the retaining portions 125 respectively so as to engage the frame 12 to the tool rack 13. The tool rack 13 further includes a plurality of ribs 135 extending from the body 131 and abutting against the annular wall 112 of the shell 11. Thus, the body 131 can be received in the shell 11 tightly. Allowable production tolerance of the body 131 and the shell 11 is also broadened.

Accordingly, the shell, the frame, and the tool rack are produced separately, thereafter the frame and the tool rack are engaged so that the shell can be retained between the frame and the tool rack. The connection portion 126 and the connection portion 226 of the two frames are rotatably coupled, thus assembling the toolbox. The appearance of the toolbox is mainly based upon the shell. The shell has a simplified structure which can be processed and treated easily.

Thus, any change or improvement of the appearance of the toolbox can be easily completed by replacing a new designed shell.

The shell is made of any one of stamping, extension, hot forming, and blow molding. The cost for equipment and molds can therefore be reduced. The quantity of each batch of mass production can thus be reduced, also reducing a manufacturers' and retailers' inventory pressure. When changing an appearance of the toolbox, the shell merely needs to be replaced. Thus, any change or improvement of the appearance of the toolbox can be easily completed by replacing a new designed shell, and production flexibility is enhanced.

In this embodiment, a number of the multiple retaining portions 125 and slots 134 are four. The retaining portions 125 are located on the external fence 123 of the frame 12. The slots 134 are formed on the engagement fringe 133 of the tool rack 13. However, number of the retaining portions and slots may be changed.

The number and positions of the retaining portions and the slots are also interchangeable and may be changed based based upon usage requirements.

Furthermore, a position of the connection portion 126 and the connection portion 226 is changeable, for example, the connection portion 126 and the connection portion 226 can be formed on the tool racks 13, 23.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A toolbox comprising:

two covers, at least one of the two covers including a shell, a frame, and a tool rack, wherein the shell includes a bottom wall and an annular wall, and the annular wall extends upward from and surrounds the bottom wall so as to define a hollow receiving space with the bottom wall, wherein the frame surrounds the annular wall and engages with the tool rack so that the shell is clipped by and between the frame and the tool rack, wherein the shell, the frame, and the tool rack are formed separately;

wherein the two covers are rotatably connected with each other and are rotated away from or close to each other so as to open or close the toolbox.

2. The toolbox as claimed in claim 1, wherein the shell includes a locking lip, and the annular wall connects the bottom wall to the locking lip, and the locking lip is retained between the frame and the tool rack.

3. The toolbox as claimed in claim 1, wherein the tool rack includes a body, a joining fringe, and an engagement fringe, wherein the body is accommodated in the hollow receiving space, the joining fringe extends perpendicularly outwardly from the body and connects between the body and the engagement fringe, the engagement fringe surrounds the annular wall, and the frame engages the engagement fringe.

4. The toolbox as claimed in claim 2, wherein the tool rack includes a body, a joining fringe, and an engagement fringe, wherein the body is accommodated in the receiving space, the joining fringe extends perpendicularly outwardly from the body and connects between the body and the engagement fringe, the engagement fringe surrounds the annular wall, the frame engages the engagement fringe, and the locking lip is retained between the joining fringe and the frame.

5. The toolbox as claimed in claim 3, wherein the tool rack further includes a plurality of ribs extending from the body and abutting against the shell.

6. The toolbox as claimed in claim 4, wherein the tool rack further includes a plurality of ribs extending from the body and abutting against the shell.

7. The toolbox as claimed in claim 3, wherein the frame includes an internal fence, an extending fence, and an external fence; wherein the extending fence connects between the internal fence and the external fence, the internal fence abuts against the annular wall, and the engagement fringe is engaged between the internal fence and the external fence.

8. The toolbox as claimed in claim 4, wherein the frame includes an internal fence, an extending fence, and an external fence; wherein the extending fence connects between the internal fence and the external fence, the internal fence abuts against the annular wall, and the engagement fringe is engaged between the internal fence and the external fence.

9. The toolbox as claimed in claim 1, wherein one of the frame and the tool rack includes multiple retaining portions, and the other of the frame and the tool rack includes multiple slots corresponding to and retaining with the multiple retaining portions respectively so as to fix the frame and the tool rack.

10. The toolbox as claimed in claim 1 further comprising multiple tools detachably accommodated in the tool rack.

* * * * *